US008006862B2

(12) United States Patent
Leslie

(10) Patent No.: US 8,006,862 B2
(45) Date of Patent: Aug. 30, 2011

(54) HOLDER, SYSTEM AND/OR METHOD FOR INSULATING AND/OR FOR SUPPORTING A CUP

(75) Inventor: Debra Leslie, Olathe, KS (US)

(73) Assignee: ITUS, LLC, Olathe, KS (US)

( * ) Notice: Subject to any disclaimer, the term of this patent is extended or adjusted under 35 U.S.C. 154(b) by 107 days.

(21) Appl. No.: 12/653,422

(22) Filed: Dec. 14, 2009

(65) Prior Publication Data

US 2011/0139803 A1 Jun. 16, 2011

(51) Int. Cl.
*B65D 25/00* (2006.01)

(52) U.S. Cl. ..... 220/739; 220/737

(58) Field of Classification Search ..... 220/737–739
See application file for complete search history.

(56) References Cited

U.S. PATENT DOCUMENTS

| | | | | |
|---|---|---|---|---|
| 3,353,729 | A * | 11/1967 | Hull | 294/156 |
| 4,399,668 | A * | 8/1983 | Williamson | 62/457.4 |
| 4,715,633 | A * | 12/1987 | Brink et al. | 294/31.2 |
| 5,147,067 | A * | 9/1992 | Effertz | 220/739 |
| 5,320,249 | A * | 6/1994 | Strech | 220/739 |
| 2005/0103795 | A1 * | 5/2005 | Hall et al. | 220/737 |
| 2009/0183299 | A1 * | 7/2009 | Conway | 2/170 |

* cited by examiner

*Primary Examiner* — Harry Grosso
(74) *Attorney, Agent, or Firm* — Patents + TMS, P.C.

(57) ABSTRACT

A holder, a system and/or a method insulate and/or support a cup. A handle assists a consumer in drinking a beverage from the cup. A cover, a liner and a spine are assembled to form the holder. The cover and the liner are attached to form a pocket for holding the spine. The handle is rigidly attached to the spine. A rigidity of the spine may support a wall of the cup. A force placed on the cup when using the handle is distributed by the spine around the wall of the cup to reduce a likelihood of failure and/or of deformation of the cup. The cover, the liner and the spine retard heat transfer to and/or from a beverage in the cup.

20 Claims, 5 Drawing Sheets

8
82
78
12
80
84
18
19
23
22

HOLDER, SYSTEM AND/OR METHOD FOR INSULATING AND/OR FOR SUPPORTING A CUP

BACKGROUND OF THE INVENTION

The present invention generally relates to a holder, a system and/or a method for insulating and/or for supporting a cup. More specifically, the present invention relates to a holder, a system and/or a method that may provide a handle for drinking a beverage from a cup, such as, for example, a disposable drinking cup. The holder, the system and/or the method may provide support to a wall of the cup. The holder, the system and/or the method may distribute pressures placed on the cup when using the handle and/or may reduce a likelihood that the wall of the cup will collapse. The holder and/or the system may be sized to fit and/or may be adjustable to fit a variety of cups that may be distributed with beverages by restaurants, convenience stores, coffee shops and/or the like.

It is generally known that retailers of beverages sell beverages, such as, for example, milk, soda, coffee, tea, water and/or the like in cups, such as, for example, disposable drinking cups that typically are generally conical in shape. Further, it is generally known that the beverages may be frozen, chilled and/or heated. However, the disposable drinking cups lack insulating structures that maintain a temperature of the beverage and/or that protect a consumer's hand from hot temperatures or cold temperatures that may be present around a wall of the cup. Further, the disposable drinking cups lack handles that assist a consumer in drinking the beverage and which prevent exposure of a hand of the consumer to the hot temperatures or cold temperatures that may be present around the wall of the cup.

As a result, known systems are provided to attach a handle to a cup to assist a consumer in drinking a beverage. The handle is typically attached to the cup with a rigid member and/or a semi-rigid member that extend from the handle and around an entire circumference of the cup to form a ring for holding the cup. Alternatively, the handle has a non-rigid strap that encircles the cup and may be tightened to attach the handle to the cup. Further, the cup may be inserted into a cup-shaped insulating sleeve to retard heat transfer to or from the beverage in the cup. The sleeve is typically non-rigid and provides insignificant support to the cup. Therefore, known sleeves with handles fail to support the wall of the cup and/or fail to reduce a likelihood that the wall of the cup will collapse. Further, known sleeves lack adjustability for use with varying cup sizes.

A need, therefore, exists for a holder, a system and/or a method for insulating and/or for supporting a cup. Additionally, a need exists for a holder, a system and/or a method that may provide a handle for drinking a beverage from a cup, such as, for example, a disposable beverage cup. Further, a need exists for a holder, a system and/or a method that may be adjustable to fit cups of varying sizes. Still further, a need exists for a holder, a system and/or a method that may be lightweight and/or easily attached to a cup. Still further, a need exists for a holder, a system and/or a method that may retard heat transfer to or from a beverage in the cup. Still further, a need exists for a holder, a system and/or a method that may distribute forces placed on the cup by a handle around a wall of the cup to reduce a likelihood that the wall of the cup will fail. Still further, a need exists for holder, a system and/or a method that may provide a surface for indicia to be displayed therefrom. Moreover, a need exists for holder, a system and/or a method that may have a liner between the handle and the cup to further insulate the beverage and to protect the wall of the cup from the handle.

SUMMARY OF THE INVENTION

The present invention generally relates to a holder, a system and/or a method for insulating and/or for supporting a cup. More specifically, the present invention relates to a holder, a system and/or a method that may provide a handle for drinking a beverage from a cup, such as, for example, a disposable drinking cup. The holder, the system and/or the method may have a cover, a liner and/or a spine. The cover and the liner may be attached together at a perimeter of both the cover and the liner to form a pocket for holding the spine.

The spine may be constructed from a semi-rigid material, such as, for example, a plastic and may be sized for placement in the pocket between the cover and the liner. The spine may be flexible to wrap around a portion of the cup when the holder and/or the system is attached to the cup. A rigidity of the spine may support a wall of the cup and/or may distribute forces around the wall of the cup to reduce a likelihood that the cup will fail.

A handle may be attached to the spine through the cover. The handle may be detachable from the spine. Alternatively, the handle may be integrally formed with the spine. Forces placed upon the cup when using the handle may be distributed by the spine around the wall of the cup to reduce a likelihood of failure and/or deformation of the cup.

The cover may be adjustable to fit a variety of sizes of the cup. Further, the cover and the liner may be constructed from a flexible and/or an insulating material, such as, for example, a neoprene, a polychloroprene, a synthetic rubber and/or the like. The cover may have mating hook and loop fasteners for fastening the cover together with the spine, the handle and/or the liner around the cup.

To this end, in an embodiment of the present invention, a system for supporting a cup wherein the cup has a circumference is provided. The system has a cover having a length defined between a first end and a second end wherein the second end of the cover is positioned opposite to the first end of the cover wherein the length of the cover is less than the circumference of the cup wherein the cover has a thickness defined between a front side and a back side wherein the back side of the cover is positioned opposite to the front side of the cover wherein the cover has a perimeter. Further, the system has a strap integrally formed with and extending from the first end of the cover wherein the strap is attachable to the front side of the cover at the second end of the cover. Still further, the system has a liner having a generally equivalent shape as the cover wherein the liner is attached to the back side of the cover. Still further, the system has a pocket formed between the cover and the liner. Still further, the system has a spine placed in the pocket between the back side of the cover and the liner wherein the spine is semi-rigid wherein the spine has a length defined between a first end and a second end wherein the second end of the spine is positioned opposite to the first end of the spine. Still further, the system has a plurality of prongs extending from the first end and the second end of the spine. Moreover, the system has a handle attached to the spine through the front side of the cover.

In an embodiment, the system has a fastener on the strap to attach the first end of the cover to the front side of the second end of the cover.

In an embodiment, the system has a fastener on the front side of the cover at the second end of the cover to attach the second end of the cover to the first end of the cover.

In an embodiment, the system has means for adjusting the length of the cover.

In an embodiment, the system has a cutout between the front side of the cover and the back side of the cover wherein the cutout is sized to attach the handle to the spine through the cover.

In an embodiment, the system has a female connector on the handle forming a ball socket. Further, the system has a male connector forming a ball joint extending from the spine through the cover wherein the female connector on the handle rotatably receives the male connector extending from the spine.

In an embodiment, the system has a male connector extending from the handle forming a latch. Further, the system has a female connector forming an indentation extending from the spine through the cover wherein the indentation of the female connector on the spine receives the latch of the male connector extending from the handle.

In an embodiment, the system has indicia displayed on at least one of the handle, the front side of the cover and the liner.

In an embodiment, the spine is constructed from a plastic.

In an embodiment, the handle is constructed from a rigid plastic.

In another embodiment, a holder for insulating a wall of a cup is provided. The holder has an insulating cover wherein the insulating cover has an arched shape wherein the insulating cover has a thickness defined between a front side and a back side wherein the back side of the insulating cover is positioned opposite to the front side of the insulating cover. Further, the holder has an insulating liner wherein the insulating liner has an arched shape wherein the insulating liner has a generally equivalent shape as the insulating cover wherein the insulating liner has a thickness defined between a front side and a back side wherein the back side of the insulating liner is positioned opposite to the front side of the insulating liner wherein the insulating liner is attached to the insulating cover forming a pocket. Still further, the holder has a spine having an arched shape wherein the spine is sized for insertion into the pocket between the back side of the insulating cover and the front side of the insulating liner wherein the spine is constructed from a flexible material wherein the spine, the insulating liner and the cover are securable to the wall of the cup. Moreover, the holder has a plurality of prongs extending from the spine wherein the plurality of prongs distribute a force placed upon the spine around the wall of the cup.

In an embodiment, the holder has a handle removably attached to the spine through the insulating cover.

In an embodiment, the holder has a handle integrally formed with the spine.

In an embodiment, the holder has a plurality of flaps formed in the insulating liner wherein the plurality of flaps maneuver in a direction away from the back side of the insulating cover to open the pocket to receive the spine wherein the plurality of flaps attach to one of the spine and the back side of the insulating cover to close the pocket.

In an embodiment, the holder has an aperture extending through the spine to expose the back side of the insulating cover to the front side of the insulating liner.

In an embodiment, the insulating cover and the insulating liner are constructed from neoprene.

In an embodiment, the holder has a fastener on the spine to attach the spine to the front side of the insulating liner.

In another embodiment, a method for supporting a cup is provided. The method has the step of providing a holder having a handle, a spine having a length defined between a first end and second end, a cover having a length defined between a first end and a second end and a liner wherein the length of the spine is less than the length of the cover wherein the spine is constructed from a material having a first rigidity to support the cup wherein the cover and the liner are constructed from an insulating material having a second rigidity wherein the spine is positioned within a pocket between the cover and the liner wherein the second rigidity of the material of the cover and the liner is less than the first rigidity of the material of the spine. Further, the method has the step of attaching the handle to the spine through the cover. Still further, the method has the step of bending the holder around the cup. Moreover, the method has the step of fastening the first end of the cover to the second end of the cover.

In an embodiment, the method has the step of adjusting the size of the holder.

In an embodiment, the method has the step of maneuvering the cup using the handle.

It is, therefore, an advantage of the present invention to provide a holder, a system and/or a method for insulating and/or for supporting a cup.

Another advantage of the present invention is to provide a holder, a system and/or a method that may provide a handle for drinking a beverage from a cup, such as, for example, a disposable drinking cup.

And, another advantage of the present invention is to provide a holder, a system and/or a method that may reduce a likelihood of failure of a cup by providing support to a wall of the cup.

Yet another advantage of the present invention is to provide a holder, a system and/or a method that may distribute pressures placed on the cup when using the handle to reduce a likelihood of a collapsing of the wall of the cup.

A further advantage of the present invention is to provide a holder, a system and/or a method that may be sized to fit and/or may be adjustable to fit a variety of cups that may be distributed with beverages by restaurants, convenience stores, coffee shops and/or the like.

Moreover, an advantage of the present invention is to provide a holder, a system and/or a method that may be lightweight.

And, another advantage of the present invention is to provide a holder, a system and/or a method that may be quickly attached to a cup.

Yet another advantage of the present invention is to provide a holder, a system and/or a method that may retard heat transfer to or from a beverage in the cup.

Another advantage of the present invention is to provide a holder, a system and/or a method that may provide a surface for indicia to be displayed therefrom.

Yet another advantage of the present invention is to provide a holder, a system and/or a method that may have a liner between the handle and the cup to further insulate the beverage and to protect the wall of the cup from the handle.

A still further advantage of the present invention is to provide a holder, a system and/or a method may have a cover, a liner and/or a spine.

Moreover, an advantage of the present invention is to provide a holder, a system and/or a method wherein the cover and the liner may be attached together at a perimeter of both the cover and the liner to form a pocket for holding the spine.

And, another advantage of the present invention is to provide a holder, a system and/or a method wherein the spine may be constructed from a semi-rigid material, such as, for example, a plastic and may be sized for placement in the pocket between the cover and the liner.

Yet another advantage of the present invention is to provide a holder, a system and/or a method wherein the spine may be flexible to wrap around a portion of the cup when the holder and/or the system is attached to the cup.

Moreover, an advantage of the present invention is to provide a holder, a system and/or a method wherein a rigidity of the spine may support a wall of the cup and/or may distribute forces around the wall of the cup to reduce a likelihood that the cup will fail.

And, another advantage of the present invention is to provide a holder, a system and/or a method wherein the handle may be attached to the spine through the cover.

Yet another advantage of the present invention is to provide a holder, a system and/or a method wherein the handle may be detachable from the spine.

Moreover, an advantage of the present invention is to provide a holder, a system and/or a method wherein the handle may be integrally formed with the spine.

And, another advantage of the present invention is to provide a holder, a system and/or a method wherein liner may be configured for insertion of the spine between the liner and the cover after the liner is attached to the cover.

Yet another advantage of the present invention is to provide a holder, a system and/or a method wherein the cover and the liner may be constructed from a flexible and/or an insulating material, such as, for example, a neoprene, a polychloroprene, a synthetic rubber and/or the like.

Moreover, an advantage of the present invention is to provide a holder, a system and/or a method wherein the cover may have mating fasteners for attaching the cover together with the spine, the handle and/or the liner around the cup.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a holder, a system and/or a method for insulating and/or for supporting a cup. More specifically, the present invention relates to a holder, a system and/or a method that may provide a handle for drinking a beverage from a cup.

Figure 2:
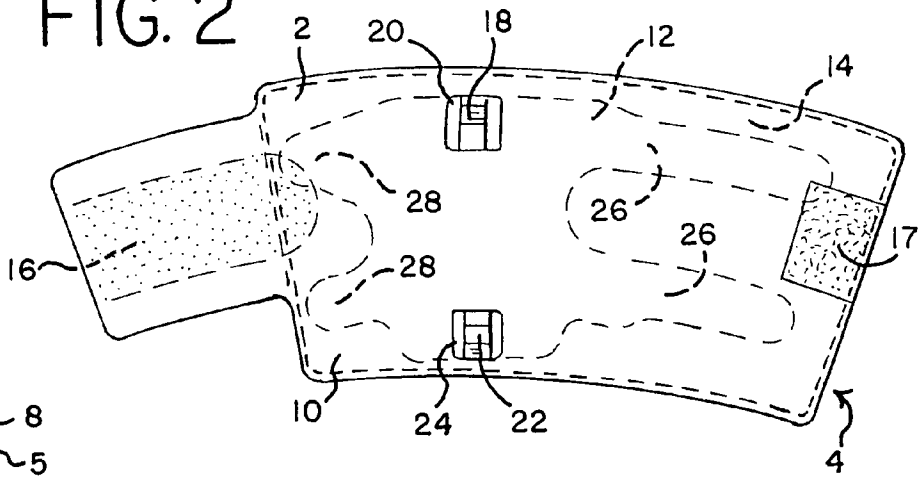
FIG. 2 illustrates a side view a holder for insulating and/or for supporting a cup in an embodiment of the present invention.
Figure 3:
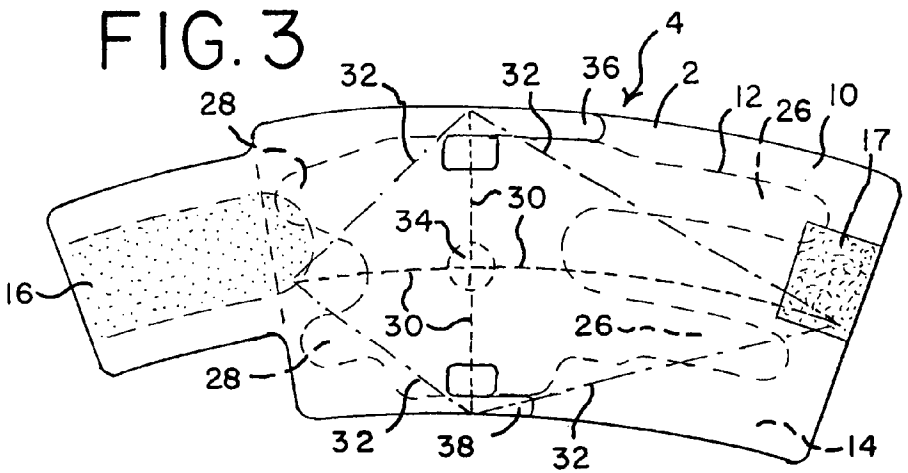
FIG. 3 illustrates a side view a holder for insulating and/or for supporting a cup in an embodiment of the present invention.
Figure 1:
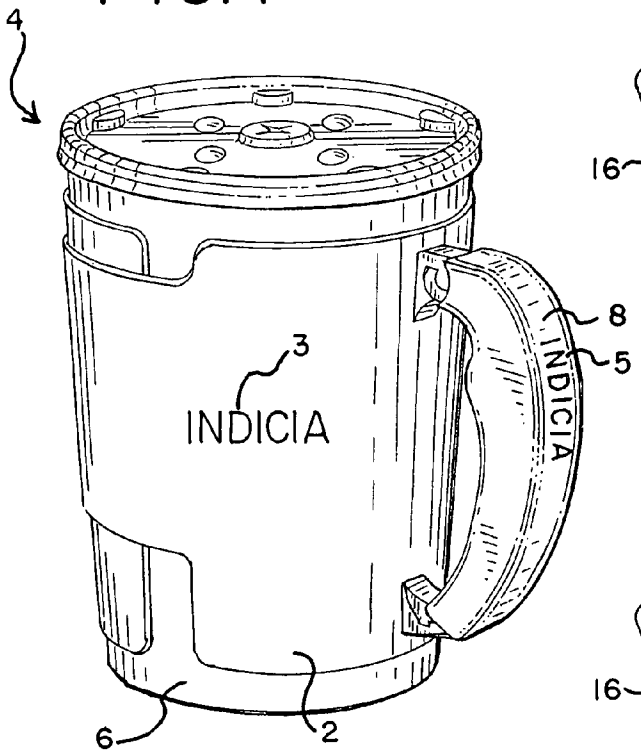
FIG. 1 illustrates a perspective view of a system for insulating and/or for supporting a cup in an embodiment of the present invention.

Referring now to the drawings wherein like numerals refer to like parts, FIGS. 1-3 illustrate a holder 2 and a system 4 for insulating and/or for supporting a cup 6. In an embodiment, the cup 6 may be, for example, a disposable drinking cup, a mug, a glass, a can, a bottle and/or the like. The cup 6 may have any shape. For example, the cup 6 may have a generally conical shape. Further, the cup 6 may be distributed with beverages sold by retailers, such as, for example, restaurants, coffee shops, convenient stores and/or the like. The present invention should not be deemed as limited to a specific embodiment of the cup 6. It should be understood that the cup 6 may be any container that may be used to hold, to transport and/or to consume a beverage, a liquid and/or a comestible mixture or solution as known to one having ordinary skill in the art.

FIGS. 1-3 illustrate embodiments of the holder 2 and the system 4. In an embodiment, the holder 2 and/or the system 4 may have a handle 8, a cover 10, a spine 12 and/or a liner 14. As illustrated in FIGS. 2 and 3, the cover 10 may be attached to the liner 14 at a perimeter of the cover 10 and the liner 14. A pocket may be formed between the cover 10 and the liner 14 by the attachment of the cover 10 to the liner 14. The spine 12 may be positioned within the pocket between the cover 10 and the liner 14 before the cover 10 is attached to the liner 14. Alternatively, the spine 12 may be inserted within the pocket through the liner 14 after the liner 14 is attached to the cover 10. The holder 2 and/or the system 4 may be an assembly of the cover 10 together with the spine 12 and/or the liner 14. The holder 2 may be wrapped around a circumference of the cup and fastened to itself to insulate, to support and/or to provide a handle to the cup.

Figure 4:
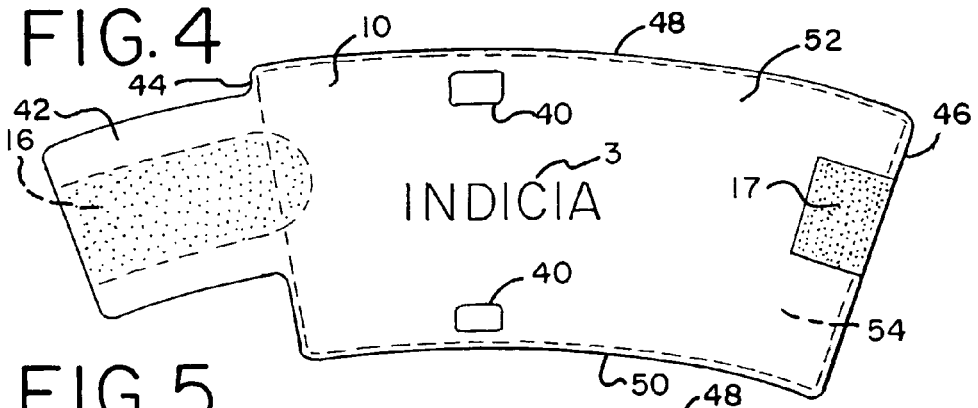
FIG. 4 illustrates a side view a cover for insulating and/or for supporting a cup in an embodiment of the present invention.
Figure 5:
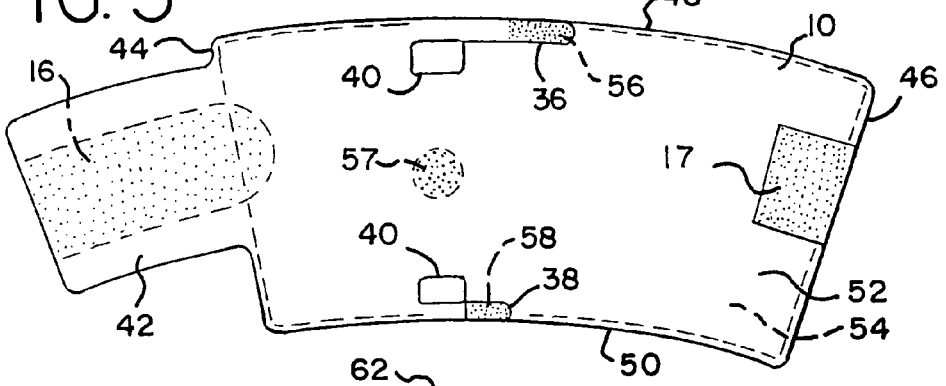
FIG. 5 illustrates a side view a cover for insulating and/or for supporting a cup in an embodiment of the present invention.

In an embodiment, as shown in FIG. 4, the cover 10 may have an arched shape for fitting to cups 6 having a variety of shapes. In an embodiment, the cup 6 may have a diameter that may decrease along a length of the cup 6 between a top end and a bottom end of the cup 6. The cover 10 may have a length defined between a first end 44 and a second end 46. The second end 46 of the cover 10 may be positioned opposite to the first end 44. The cover 10 may have a height defined between a top side 48 and a bottom side 50. The bottom side 50 of the cover 10 may be positioned opposite to the top side 48 of the cover 10. The cover 10 may have a thickness defined between a front side 52 and a back side 54. The back side 54 of the cover 10 may be positioned opposite to the front side 52 of the cover 10. The cover 10 may have a strap 42 that may extend from the first end 44 of the cover 10. As illustrated in FIGS. 4 and 5, the strap 42 may have a height that may be less than the height of the cover 10. The cover 10 together with the strap 42 may have an overall length that may be greater than a maximum circumference of the cup 6.

The cover 10 and/or the strap 42 may be constructed from a flexible and/or an insulating material, such as, for example, a neoprene, a polychloroprene, a synthetic rubber and/or the like. However, it should be understood that the cover 10 and/or the strap 42 may be constructed from any flexible and/or insulating material known to a person of ordinary skill in the art.

The cover 10 may have cutouts 40 that may extend through the cover 10 between the front side 52 and the back side 54 of the cover 10. The handle 8 may pass through the cutouts 40 of the cover 10. Further, the cover 10 may have fasteners 16, 17 that may be used to secure the strap 42 of the cover 10 to the front side 52 of the cover 10 at the second end 46 of the cover 10. The fastener 6 may extend along the back side 54 of the cover 10 along the strap 42 at the first end 44 of the cover 10. The fastener 17 may be positioned on the front side 52 of the cover 10 at the second end 46 of the cover 10. A user of the holder 2 and/or the system 4 may wrap the holder 2 around a circumference of the cup 6 and attach the fastener 16 of the strap 42 to the fastener 17 on the front side 52 of the cover 10 at the second end 46 of the cover 10 to secure the holder 2 to the cup 6. In an embodiment, the fasteners 16, 17 may be, for example, hook and loop fasteners, button and snap fasteners, zipper fasteners, press fit fasteners and/or the like. It should be understood that the fasteners 16, 17 may be any fastener for attaching the strap 42 to the front side 52 of the cover 10 as known to one having ordinary skill in the art. The present invention should not be deemed as limited to a specific embodiment of the fasteners 16, 17.

As illustrated in FIG. 5, the cover 10 may have fingers 36, 38 that may extend adjacent to the cutouts 40 along the length of the cover 10. The fingers 36, 38 may have fasteners 56, such as, for example, hook and loop fasteners, that may be used to attach the fingers 36, 38 to the liner 14. The fingers 36, 38 may be used to adjust the length of the cover 10 for varying sizes of the cup 6. Further, the strap 42 may be used to affix the holder 2 to the cups 6 having various sizes.

Figure 6:
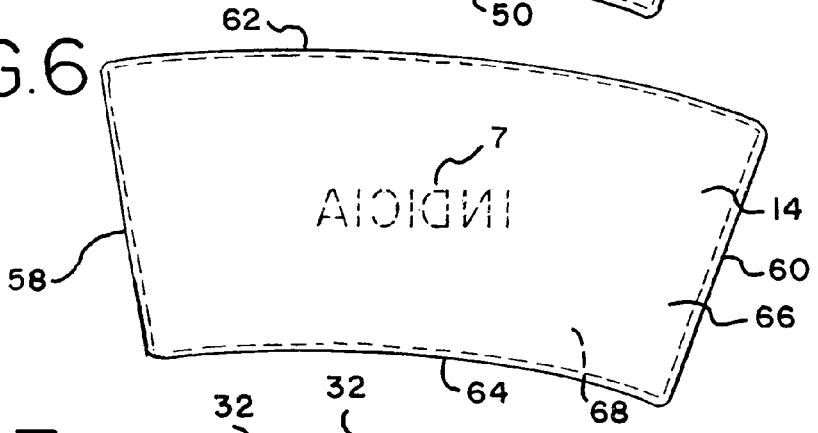
FIG. 6 illustrates a side view a liner for insulating and/or for supporting a cup in an embodiment of the present invention.
Figure 7:
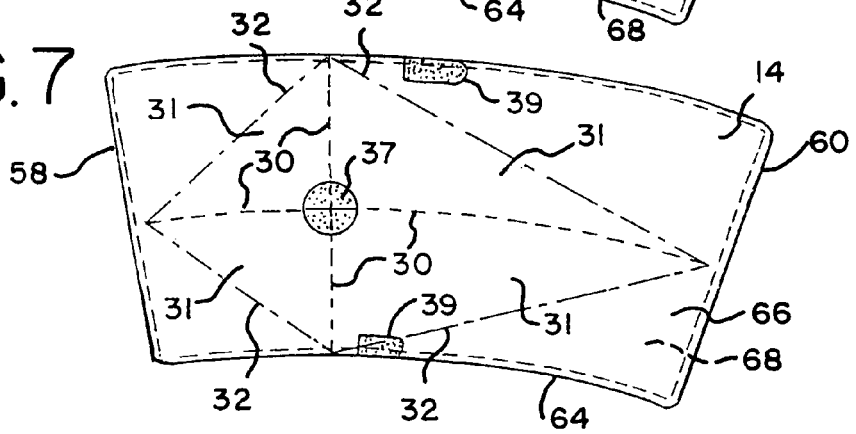
FIG. 7 illustrates a side view a liner for insulating and/or for supporting a cup in an embodiment of the present invention.

As illustrated in FIGS. 6 and 7, the liner 14 may have an arched shape for fitting around the cups 6. The liner 14 may have a generally similar shape and size as the cover 10. The liner 14 may have a length defined between a first end 58 and a second end 60. The second end 60 of the liner 14 may be positioned opposite to the first end 58. The liner 14 may have a height defined between a top side 62 and a bottom side 64. The bottom side 64 of the liner 14 may be positioned opposite to the top side 62 of the liner 14. The liner 14 may have a thickness defined between a front side 66 and a back side 68. The back side 68 of the liner 14 may be positioned opposite to the front side 66 of the liner 14.

As illustrated in FIGS. 2 and 3, the liner 14 may be attached to the cover 10 at a perimeter of the liner 14 to form the pocket between the back side 54 of the cover 10 and the front side 66 of the liner 14. The liner 14 may be attached to the cover 10 by any means known to a person having ordinary skill in the art. In an embodiment, the liner 14 may be sewn and/or stitched to the cover 10 as shown in FIG. 2. Alternatively, the liner 14 may be attached to the cover 10 with an adhesive (not shown). The present invention should not be deemed as limited to a specific embodiment of the means for attaching the liner 14 to the cover 10.

The liner 14 may be constructed from a flexible and/or an insulating material, such as, for example, a neoprene, a polychloroprene, a synthetic rubber and/or the like. However, it should be understood that the liner 14 may be constructed from any flexible material and/or insulating material known to a person of ordinary skill in the art.

Figure 9:
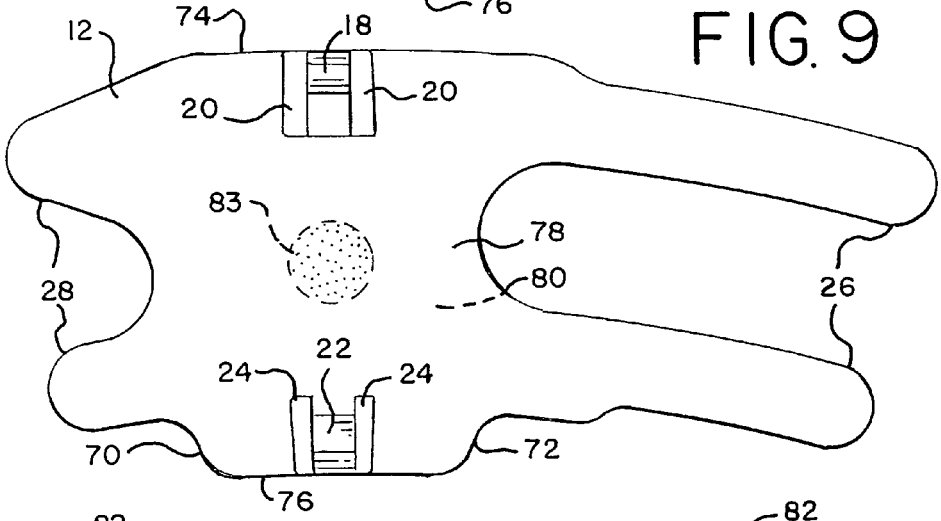
FIG. 9 illustrates a side view a spine for insulating and/or for supporting a cup in an embodiment of the present invention.
Figure 10:
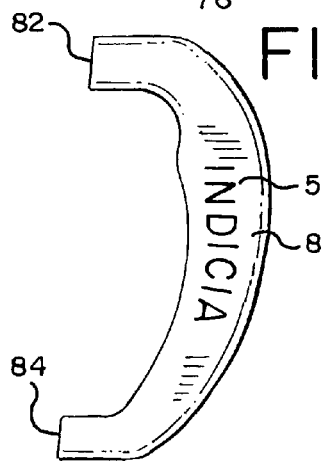
FIG. 10 illustrates a side view a handle for insulating and/or for supporting a cup in an embodiment of the present invention.
Figure 11:
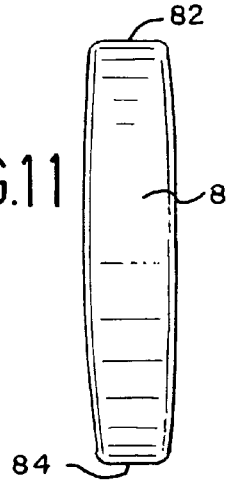
FIG. 11 illustrates a front view a handle for insulating and/or for supporting a cup in an embodiment of the present invention.

In an embodiment, as illustrated in FIG. 7, the liner 14 may have cut lines 30 that may extend between the front side 66 and the back side 68 of the liner 14. The cut lines 30 may form flaps 31 in the liner 14 that may be foldable at the fold lines 32. The flaps 31 may be opened to allow the spine 12 to be inserted into the pocket between the back side 54 of the cover 10 and the front side 66 of the liner 14 after the liner 14 may be attached to the cover 10. Each of the flaps 31 may have fasteners 37, such as, for example, hook and loop fasteners, to attach the flaps 31 to a fastener 83, such as, for example, a hook and loop fastener, on a back side 80 of the spine 12 as shown in FIG. 9. Alternatively, the fasteners 37 may attach the flaps 31 through an aperture 81 in the spine 12 to a fastener 57, such as, for example, a hook and loop fastener, on the back side 54 of the cover 10, as shown in FIG. 5. In an embodiment, as illustrated in FIG. 7, the front side 66 of the liner 14 may have fasteners 39, such as, for example, hook and loop fasteners, to receive the fasteners 56 of the fingers 36, 38 of the cover 10.

Figure 8:
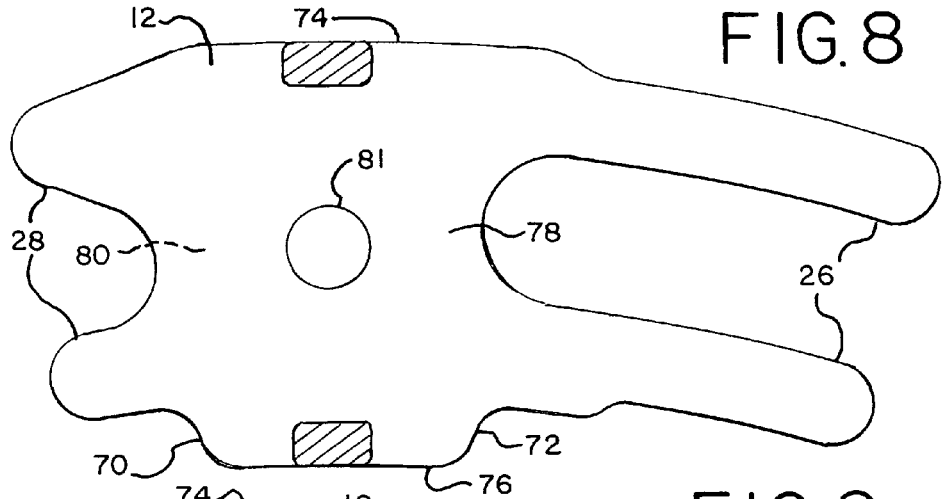
FIG. 8 illustrates a side view a spine for insulating and/or for supporting a cup in an embodiment of the present invention.
Figure 16:
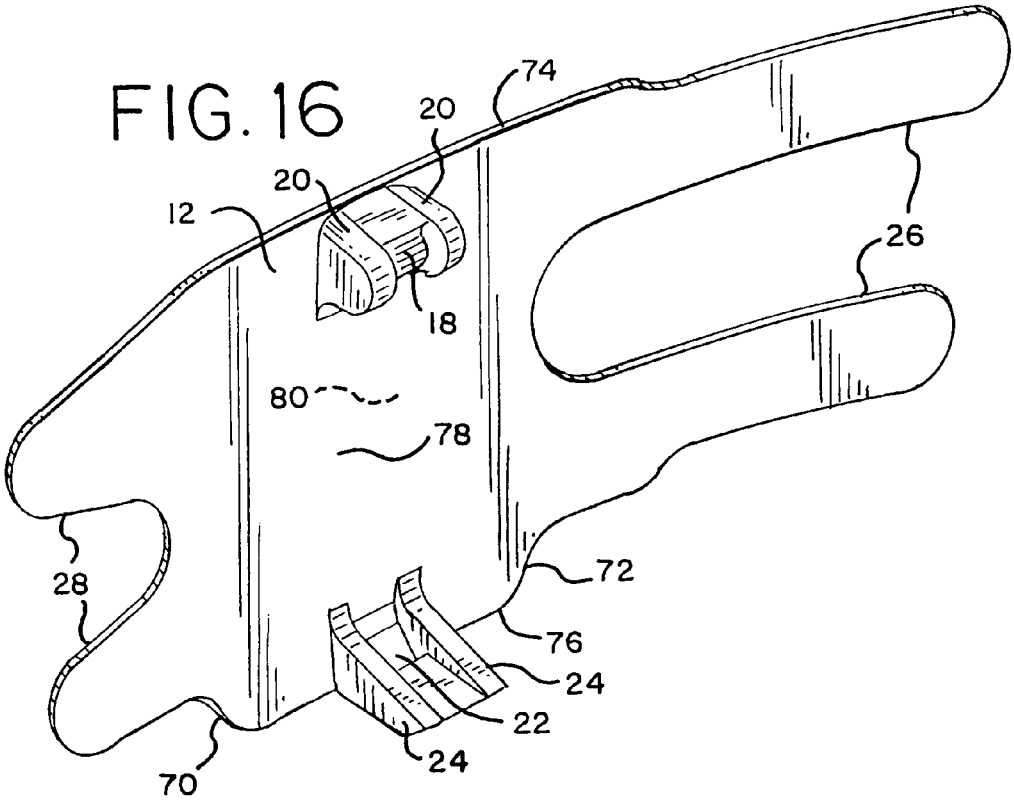
FIG. 16 illustrates a perspective view of a spine for insulating and/or for supporting a cup in an embodiment of the present invention.

As illustrated in FIGS. 2, 3, 8 and 9, the spine 12 may have an arched shape for fitting to the cups 6. As illustrated in FIGS. 8, 9 and 16, the spine 12 may have a first end 70 and a second end 72. The second end 72 of the spine 12 may be positioned opposite to the first end 70. The spine 12 may have a height defined between a top side 74 and a bottom side 76. The bottom side 76 of the spine 12 may be positioned opposite to the top side 74 of the spine 12. The spine 12 may have a thickness defined between a front side 78 and a back side 80. The back side 80 of the spine 12 may be positioned opposite to the front side 78 of the spine 12.

The spine 12 may have one or more prongs 26 that may extend from the second end 72 of the spine 12. Further, the spine 12 may have one or more prongs 28 that may extend from the first end 70 of the spine 12. As shown in FIGS. 8 and 9, the prongs 26 may extend a length from the second end 72 of the spine 12 that may be greater than a length that the prongs 28 may extend from a first end 70 of the spine 12. The prongs 26, 28 may simulate a hand, fingers and/or a thumb of a consumer that may be wrapped around the cup 6 when maneuvering the cup 6 without a handle. The prongs 26, 28 may be an extension of the spine and may be constructed from the same material as the spine 12. The prongs 26, 28 may be integrally formed with the spine 12, as shown in FIGS. 8 and 9. Alternatively, one or more of the prongs 26, 28 may be attached to the spine 12. The prongs 26, 28 may have a thickness that may be equal to, greater than and/or less than the thickness of the spine 12. The spine 12 together with the prongs 26, 28 may have an overall length that may be less than a corresponding length of the cover 10 and the liner 14. The spine 12 together with the prongs 26, 28 may have an overall length that may be less than a maximum circumference of the cup 6. As a result, the spine 12 may be sized for placement in the pocket between the cover 10 and the liner 14. In an embodiment, the prongs 26, 28 may have a rounded tip at an end of the prongs 26, 28 that may be in a position that may be distal from the second end 72 and the first end 70 of the spine 12, respectively.

The spine 12 may be constructed from a semi-rigid and/or a flexible material, such as, for example, plastic, wood and/or the like. In an embodiment, the spine 12 has a rigidity that is greater than any rigidity of the cover 10 and/or the liner 14. The spine 12 together with the prongs 26, 28 may be flexible enough to be wrapped around a circumference of the cup 6 without fracturing, splintering and/or failing. However, the spine 12 may be rigid enough to support a wall of the cup 6 and/or to distribute forces placed on the cup 6 when using the handle 8 to hold, to tip and/or to maneuver the cup 6. It should be understood that the spine 12 may be constructed from any semi-rigid and/or flexible material as known to one having ordinary skill in the art.

In an embodiment, as illustrated in FIGS. 8 and 10-12, the handle 8 may be integrally formed with and/or unremovably attached to the front side 78 of the spine 12. The handle 8 may be formed with the spine 12 as a single piece. In an embodiment, as illustrated in FIGS. 9 and 13-18, the handle 8 may be removably attached to the front side 78 of the spine 12. The handle 8 may have a top end 82 and a bottom end 84 that may be situated in a position distal to the top end 82 of the handle 8. The handle 8 may be constructed from a rigid and/or a semi-rigid material, such as, for example, a plastic, a metal, a wood, a corrugated paper and/or the like.

The spine 12 may have a ball joint 18 and/or a ball joint cover 20 that may be integrally formed with and that may extend from the front side 78 of the spine 12 at or near the top side 74 of the spine 12. The spine 12 may have a snap joint 22 and/or a snap joint cover 24 that may be integrally formed with and that may extend from the front side 78 of the spine 12 at or near the bottom side 76 of the spine 12. The ball joint 18 may be sized to receive a ball joint attachment 19 which may extend from the top end 82 of the handle 8. The snap joint 22 may be sized to receive a snap joint attachment 23 which may extend from the bottom end 84 of the handle 8.

Figures 12, 13, 14, 15:
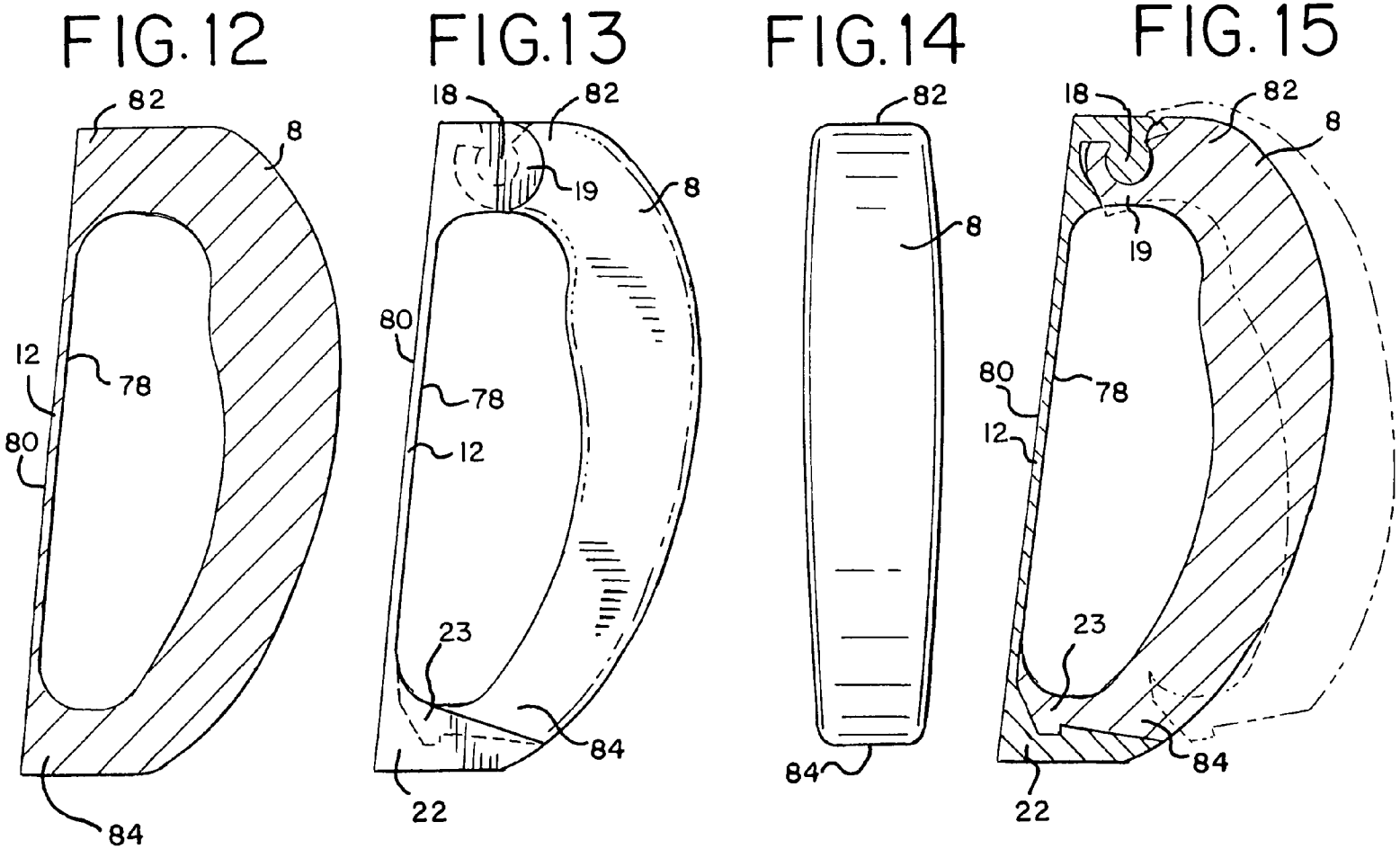
FIG. 12 illustrates a cross-sectional view of a handle and a spine for insulating and/or for supporting a cup in an embodiment of the present invention.
FIG. 13 illustrates a side view a handle for insulating and/or for supporting a cup in an embodiment of the present invention.
FIG. 14 illustrates a front view a handle for insulating and/or for supporting a cup in an embodiment of the present invention.
FIG. 15 illustrates a cross-sectional view of a handle and a spine for insulating and/or for supporting a cup in an embodiment of the present invention.
Figure 17:
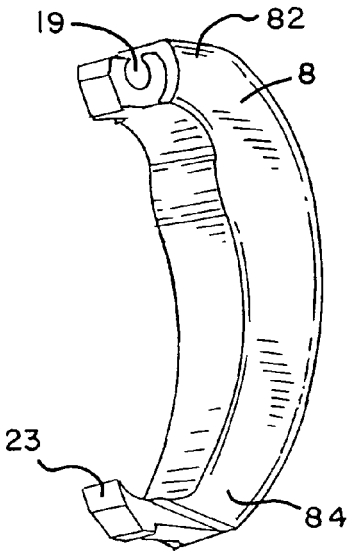
FIG. 17 illustrates a perspective view of a handle for insulating and/or for supporting a cup in an embodiment of the present invention.
Figure 18:
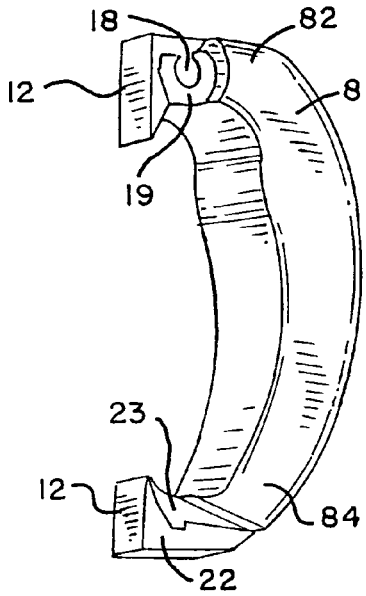
FIG. 18 illustrates a perspective view of a handle and a portion of a spine for insulating and/or for supporting a cup in an embodiment of the present invention.

As illustrated in FIGS. 15, 17 and 18, to attach the handle 8 to the spine 12, the ball joint attachment 19 of the top end 82 of the handle 8 may be inserted into the ball joint 18 of the spine 12. The bottom end 84 of the handle may be swiveled into place to engage the snap joint attachment 23 at the bottom end 84 of the handle 8 into the snap joint 22 of the spine 12. To remove the handle 8 from the spine 12, the snap joint attachment 23 may be disengaged from the snap joint 22, and the ball joint attachment 19 may then be disengaged from the ball joint 18 of the spine 12. In a preferred embodiment, the ball joint 18 and the snap joint 22 may be used to removably attach the handle 8 through the cutouts 40 of the cover 10 to the spine 12. However, it should be understood that the means for removably attaching the handle 8 to the spine 12 may be any means of removably attaching the handle 8 to the spine 12 as known to one having ordinary skill in the art.

To assemble the system 4, the cover 10 may be attached to the liner 14 at a perimeter of both the cover 10 and the liner 14. The cover 10 may be attached to the liner 14 with, for example, stitching, an adhesive and/or the like. The spine 12 may be placed in the pocket formed between the cover 10 and the liner 14 during assembly. Alternatively, the spine 12 may be inserted into the pocket formed between the cover 10 and the liner 14 after the cover 10 is attached to the liner 14. In this alternate embodiment, the flaps 31 of the liner 14 may be opened and pulled away from the back side 54 of the cover. The spine 12 may be inserted into the pocket, and the flaps 31 may be closed by pushing the flaps 31 towards the back side 80 of the spine 12. In an embodiment, the back side 80 of the spine 12 may have the fastener 83 for attaching the fasteners 37 of the flaps 31 thereto. In an alternate embodiment, the flaps 31 and the fasteners 37 may pass through the aperture 81 in the spine 12 to attach the flaps 31 to the fastener 57 that may be positioned on the back side 54 of the cover 10. The spine 12 may then be securely situated within the pocket with the ball joint 18 and the snap joint 22 extending through the cutouts 40 in the cover 10. The handle 8 may be attached to the ball joint 18 and the snap joint 22 of the spine 12 with the ball joint attachment 19 and the snap joint attachment 23.

To apply the system 4 to the cup 6, the holder 2 may be bent and wrapped around the circumference of the cup 6, as illustrated in FIG. 1. The fastener 16 on the back side 54 of the strap 42 may be used to attach the strap 42 to the fastener 17 that may be on the front side 52 of the cover 10 at the second end 46 of the cover 10. A fit of the holder 2 to the cup 6 may be further adjusted by positioning the fingers 36, 38 and attaching the fingers 36, 38 of the cover 10 to the liner 14 with fasteners 56, 39. The material of the cover 10, the spine 12 and/or the liner 14 may insulate the cup 6 and any contents therein retarding heat transfer into and out of the cup 6. When using the handle 8 to maneuver the system 4 together with the cup 6 and its contents, forces placed on the cup 6 through use of the handle 8 are distributed around and across the wall of the cup 6 through the spine 12 and the prongs 26, 28 of the spine 12. The distribution of the forces placed on the cup 6 may reduce a likelihood of a deformation and/or a failure of the cup 6 and may further reduce a likelihood of spillage of the contents of the cup 6. The system 4 is removed from the cup 6 by disengaging the fasteners 16, 17 and maneuvering the holder 2 away from the cup 6 with the handle 8.

As illustrated in FIGS. 1, 4, 6 and 10, indicia 3, 5, 7 may be, for example, printed, affixed, branded and/or engraved on the front side 52 of the cover 10, the back side 68 of the liner 14 and/or the handle 8. The indicia 3, 5, 7 may display, for example, promotional advertisements, trademarks, instructions for using and/or for adjusting the holder 2 and/or the like. It should be understood that the indicia 3, 5, 7 may be any indicia and may be affixed, engraved and/or imprinted on the cover 10, the sleeve 14 and/or the handle 8 in any way as known to one having ordinary skill in the art.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A system for supporting a cup wherein the cup has a circumference, the system comprising:

a cover having a length defined between a first end and a second end wherein the second end of the cover is positioned opposite to the first end of the cover wherein the length of the cover is less than the circumference of the cup wherein the cover has a thickness defined between a front side and a back side wherein the back side of the cover is positioned opposite to the front side of the cover wherein the cover has a perimeter;

a strap integrally formed with and extending from the first end of the cover wherein the strap is attachable to the front side of the cover at the second end of the cover;

a liner having a generally equivalent shape as the cover wherein the liner is attached to the back side of the cover;

a pocket formed between the cover and the liner;

a spine placed in the pocket between the back side of the cover and the liner wherein the spine is semi-rigid wherein the spine has a length defined between a first end and a second end wherein the second end of the spine is positioned opposite to the first end of the spine;

a plurality of prongs extending from the first end and the second end of the spine; and a handle attached to the spine through the front side of the cover.

2. The system of claim 1 further comprising:

a fastener on the strap to attach the first end of the cover to the front side of the second end of the cover.

3. The system of claim 1 further comprising:

a fastener on the front side of the cover at the second end of the cover to attach the second end of the cover to the first end of the cover.

4. The system of claim 1 further comprising:

means for adjusting the length of the cover.

5. The system of claim 1 further comprising:

a cutout between the front side of the cover and the back side of the cover wherein the cutout is sized to attach the handle to the spine through the cover.

6. The system of claim 1 further comprising:

a female connector on the handle forming a ball socket; and a male connector forming a ball joint extending from the spine through the cover wherein the female connector on the handle rotatably receives the male connector extending from the spine.

7. The system of claim 1 further comprising:

a male connector extending from the handle forming a latch; and a female connector forming an indentation extending from the spine through the cover wherein the indentation of the female connector on the spine receives the latch of the male connector extending from the handle.

8. The system of claim 1 further comprising:

indicia displayed on at least one of the handle, the front side of the cover and the liner.

9. The system of claim 1 wherein the spine is constructed from a plastic.

10. The system of claim 1 wherein the handle is constructed from a rigid plastic.

11. A holder for insulating a wall of a cup, the holder comprising:

an insulating cover wherein the insulating cover has an arched shape wherein the insulating cover has a thickness defined between a front side and a back side wherein the back side of the insulating cover is positioned opposite to the front side of the insulating cover;

an insulating liner wherein the insulating liner has an arched shape wherein the insulating liner has a generally equivalent shape as the insulating cover wherein the insulating liner has a thickness defined between a front side and a back side wherein the back side of the insulating liner is positioned opposite to the front side of the insulating liner wherein the insulating liner is attached to the insulating cover forming a pocket;

a spine having an arched shape wherein the spine is sized for insertion into the pocket between the back side of the insulating cover and the front side of the insulating liner wherein the spine is constructed from a flexible material wherein the spine, the insulating liner and the cover are securable to the wall of the cup; and a plurality of prongs extending from the spine wherein the plurality of prongs distribute a force placed upon the spine around the wall of the cup.

12. The holder of claim 11 further comprising:

a handle removably attached to the spine through the insulating cover.

13. The holder of claim 11 further comprising:

a handle integrally formed with the spine.

14. The holder of claim 11 further comprising:

a plurality of flaps formed in the insulating liner wherein the plurality of flaps maneuver in a direction away from the back side of the insulating cover to open the pocket to receive the spine wherein the plurality of flaps attach to one of the spine and the back side of the insulating cover to close the pocket.

15. The holder of claim 11 further comprising:

an aperture extending through the spine to expose the back side of the insulating cover to the front side of the insulating liner.

16. The holder of claim 11 wherein the insulating cover and the insulating liner are constructed from neoprene.

17. The holder of claim 11 further comprising:

a fastener on the spine to attach the spine to the front side of the insulating liner.

18. A method for supporting a cup, the method comprising the steps of:

providing a holder having a handle, a spine having a length defined between a first end and second end, a cover having a length defined between a first end and a second end and a liner wherein the length of the spine is less than the length of the cover wherein the spine is constructed from a material having a first rigidity to support the cup wherein the cover and the liner are constructed from an insulating material having a second rigidity wherein the spine is positioned within a pocket between the cover and the liner wherein the second rigidity of the material of the cover and the liner is less than the first rigidity of the material of the spine;

attaching the handle to the spine through the cover;

bending the holder around the cup; and fastening the first end of the cover to the second end of the cover.

19. The method of claim 18 further comprising the step of:

adjusting the size of the holder.

20. The method of claim 18 further comprising the step of:

maneuvering the cup using the handle.

* * * * *